US006561395B2

(12) United States Patent
Lim et al.

(10) Patent No.: US 6,561,395 B2
(45) Date of Patent: May 13, 2003

(54) COLLAPSIBLE BACK PACK

(76) Inventors: Mona Lim, Sofpak Technologies Inc., 706 E. Gude Dr., Suite B, Rockville, MD (US) 20850; Casey Lim, Sofpak Technologies Inc., 706 E. Gude Dr., Suite B, Rockville, MD (US) 20850

( * ) Notice: Subject to any disclaimer, the term of this patent is extended or adjusted under 35 U.S.C. 154(b) by 0 days.

(21) Appl. No.: 09/993,716

(22) Filed: Nov. 27, 2001

(65) Prior Publication Data

US 2002/0125277 A1 Sep. 12, 2002

(30) Foreign Application Priority Data

Mar. 6, 2001 (KR) ..... 0251542

(51) Int. Cl.[7] ..... A45F 3/08

(52) U.S. Cl. ..... 224/261; 190/103; 190/104; 224/153; 224/627; 224/628

(58) Field of Search ..... 224/261, 153, 224/581, 627, 628, 629; 190/107, 103, 100, 104, 105; 210/655, 652

(56) References Cited

U.S. PATENT DOCUMENTS

| | | | | | |
|---|---|---|---|---|---|
| 2,712,404 | A | | 7/1955 | Miller | |
| 3,233,803 | A | | 2/1966 | Gray | |
| 4,362,307 | A | | 12/1982 | Nakatani | |
| 4,593,841 | A | * | 6/1986 | Lange | 224/153 |
| 4,917,401 | A | * | 4/1990 | Iwaki | 280/655 |
| 5,167,306 | A | * | 12/1992 | Carrigan, Jr. | 190/18 A |
| 5,292,043 | A | | 3/1994 | McHale | |
| 5,374,073 | A | * | 12/1994 | Hung-Hsin | 280/30 |
| 5,460,307 | A | | 10/1995 | Stevenson | |
| 5,564,720 | A | | 10/1996 | Stringer | |
| 5,575,362 | A | | 11/1996 | Franklin et al. | |
| 5,590,897 | A | | 1/1997 | Tsai | |
| 5,639,109 | A | | 6/1997 | Liang | |
| 5,671,831 | A | * | 9/1997 | Chiu | 190/103 |
| 5,743,447 | A | | 4/1998 | McDermott | |
| 5,893,495 | A | | 4/1999 | Godshaw et al. | |
| 5,951,037 | A | | 9/1999 | Hsieh et al. | |
| 6,129,254 | A | * | 10/2000 | Yu | 190/110 |
| 6,179,176 | B1 | * | 1/2001 | Saggese et al. | 190/18 A |
| 6,202,910 | B1 | * | 3/2001 | Swetish | 190/104 |
| 6,220,411 | B1 | * | 4/2001 | Scicluna et al. | 190/103 |
| 6,408,997 | B1 | * | 6/2002 | Chen | 190/103 |

* cited by examiner

*Primary Examiner*—Stephen K. Cronin
*Assistant Examiner*—Maerena Brevard
(74) *Attorney, Agent, or Firm*—Richard C. Litman

(57) ABSTRACT

The present invention is drawn to a backpack structure, which structure allows a user to carry the backpack on his/her shoulders or, if desired, to transport the backpack in a wheeled fashion. The structure comprises a horizontally positioned base member which has a sliding front portion. An expandable and compressible backpack is mounted on the base member. In a retracted state, the base member and backpack are almost half their expanded size so that the structure may be conveniently stored in compact locations. Actuator mechanisms are conveniently located on the base member to allow a user to quickly and easily release the sliding portion and backpack for expansion. The sliding portion and backpack are easily pushed into a retracted position and are automatically locked therein.

18 Claims, 4 Drawing Sheets

COLLAPSIBLE BACK PACK

BACKGROUND OF THE INVENTION

1. Field of the Invention

The present invention generally relates to luggage apparatus. More specifically, the present invention is drawn to a wheeled backpack capable of being expanded or compressed.

2. Description of the Related Art

Once the province of campers, mountain climbers, and hikers, backpacks have recently become a popular form of portable luggage for students, travelers and even shoppers. Backpacks have proven to be convenient for storing books and school supplies; for packing clothes therein for air, bus or train travel; or for carting groceries from the local supermarket. At times, it is more convenient to wheel the backpack instead of supporting the same from the user's shoulders. Thus, to provide an expandable, wheeled backpack, which backpack may be easily compressed for storage would certainly be a welcomed addition to the art.

U.S. Pat. Nos. 2,712,404 (Miller) and 3,233,803 (Gray) show structure for supporting backpacks thereon. There is no contemplation to expand and retract the support structure or to provide wheels therefor.

U.S. Pat. No. 5,292,043 (McHale) discloses a backpack having an extendible frame. There is no wheeled base for supporting the backpack.

U.S. Pat. No. 5,564,720 (Stringer) is drawn to a portable game cart for use by hunters. No provision is made to support a backpack or traveling bag on the cart when the cart is supported from the user's shoulders.

U.S. Pat. No. 5,575,362 (Franklin et al.) shows a wheeled garment bag which is equipped with a collapsible pull handle. The garment bag is not adapted to be supported on the back of a user and there is no means for expansion and compression of the bag.

U.S. Pat. Nos. 5,743,447 (McDermott) and 5,893,495 (Godshaw et al.) disclose wheeled backpacks. There is no provision to support the backpacks for expansion and compression.

U.S. Pat. No. 5,639,109 (Liang) is drawn to a luggage trolley having a collapsible handle. The patentee does not contemplate carrying the trolley on the back of the user. Also, no provision is made to expand and retract the trolley's base.

U.S. Pat. Nos. 4,362,307 (Nakatani) and 5,460,307 (Stevenson) disclose foldable carts adapted to be shoulder carried. The carts do not have expandable and retractable bases.

U.S. Pat. Nos. 5,590,897 (Tsai) and 5,951,037 (Hsieh et al.) show luggage carts each having an expandable and retractable base. However, there is no provision to expand or compress a backpack mounted on the base. The instant patents also do not disclose the easy base release mechanisms as contemplated in the instant invention.

None of the above inventions and patents, taken either singularly or in combination, is seen to disclose an expandable and compressible backpack and support as will subsequently described and claimed in the instant invention.

SUMMARY OF THE INVENTION

The present invention is drawn to a backpack structure, which structure permits a user to carry the backpack on his/her shoulders or, if desired, to transport the backpack in a wheeled fashion.

The structure comprises a horizontally positioned base member which has a sliding front portion. An expandable and compressible backpack is mounted on the base member. In a retracted state, the base member and backpack are almost half their expanded size so that the structure may be conveniently stored in compact locations, especially school lockers and like sized storage bins. Actuator mechanisms are conveniently located on the base member to allow a user to quickly and easily release the sliding portion and backpack for expansion. The sliding portion and backpack are easily pushed into a retracted position and are automatically locked therein.

Sturdy wheels, of the skate board type, are disposed on the rear, bottom face of the base. Leg members are disposed on the front, bottom face so that the base rests in a substantially level position. A handle member extends vertically from the rear, upper face of the base. Back-friendly shoulder straps are detachably disposed on the handle so tat the structure may be carried on the user's back.

Accordingly, it is a principal object of the invention to provide a unique backpack for carrying materials therein.

It is another object of the invention to provide a backpack, which backpack may easily be compressed for storage.

It is a further object of the invention to provide a backpack, which backpack can be compressed to almost half its expanded size.

Still another object of the invention is to provide a backpack, which backpack may be wheeled or carried as desired.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
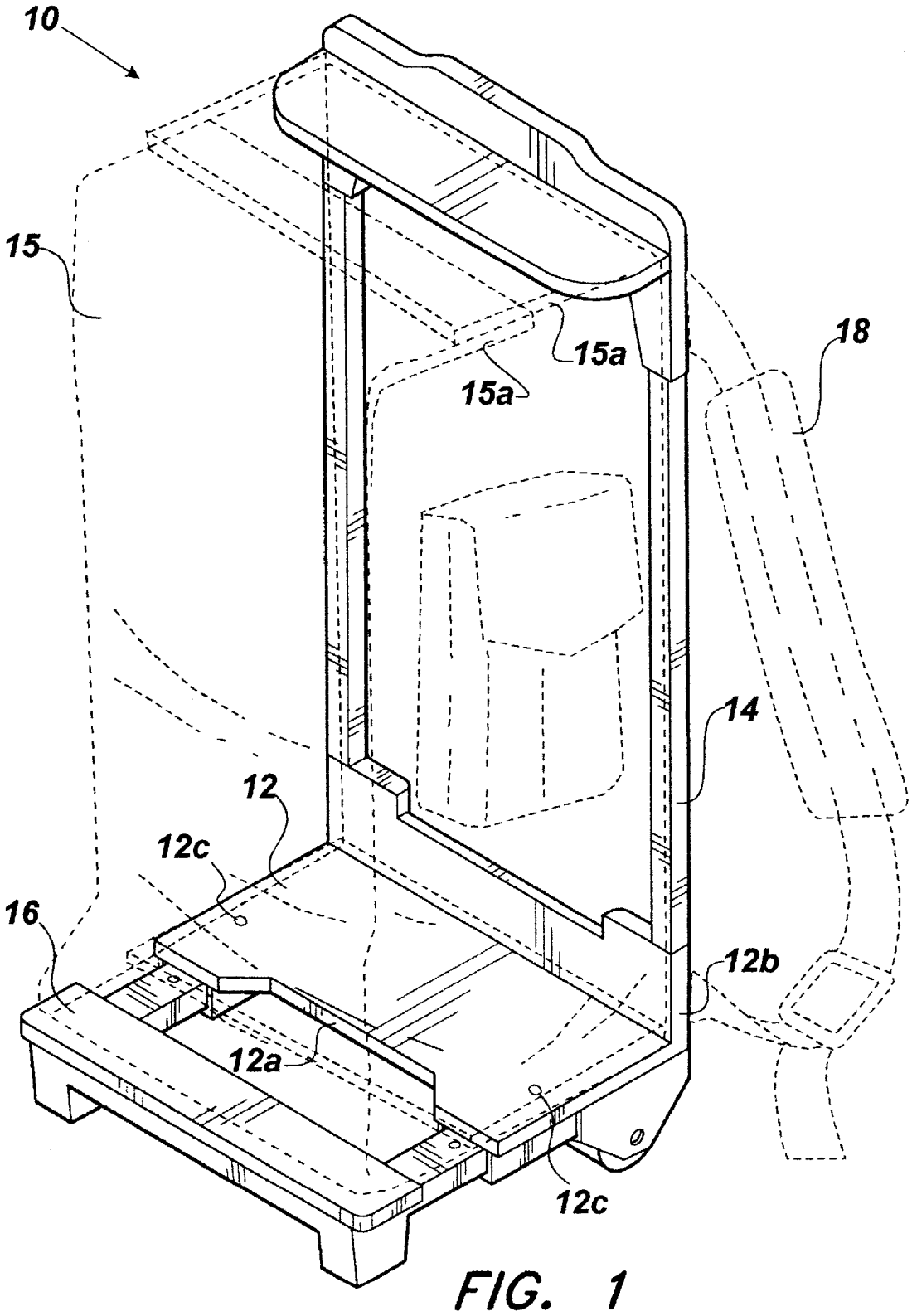
FIG. 1 is a perspective view of a backpack and support structure therefor according to the present invention.

Attention is first directed to FIG. 1 of the drawings wherein the backpack and support structure of the present invention is generally indicated at 10. Structure 10 comprises a base member 12 having a front end 12*a* and a rear end 12*b*. Member 12 is adapted to assume a substantially horizontal disposition in use and is designed to support a backpack 15 (shown in phantom lines) thereon. A handle member 14 extends vertically upward from rear end 12*b*. Handle 14 may be integrally formed with base member 12 or may be attached thereto in any efficient and convenient manner (screws, bolts, welds, etc.). A movable member 16 is telescopically coupled to member 12 and is adapted to move outwardly from member 12 to increase or expand the effective area of base 12. Detachable, ergonomic shoulder straps 18 are disposed on handle 14 so that the structure may be comfortably carried on the back of a user if desired. Backpack 15 is provided with overlapping top and bottom walls 15*a* for reasons as will be explained below.

Figure 2:
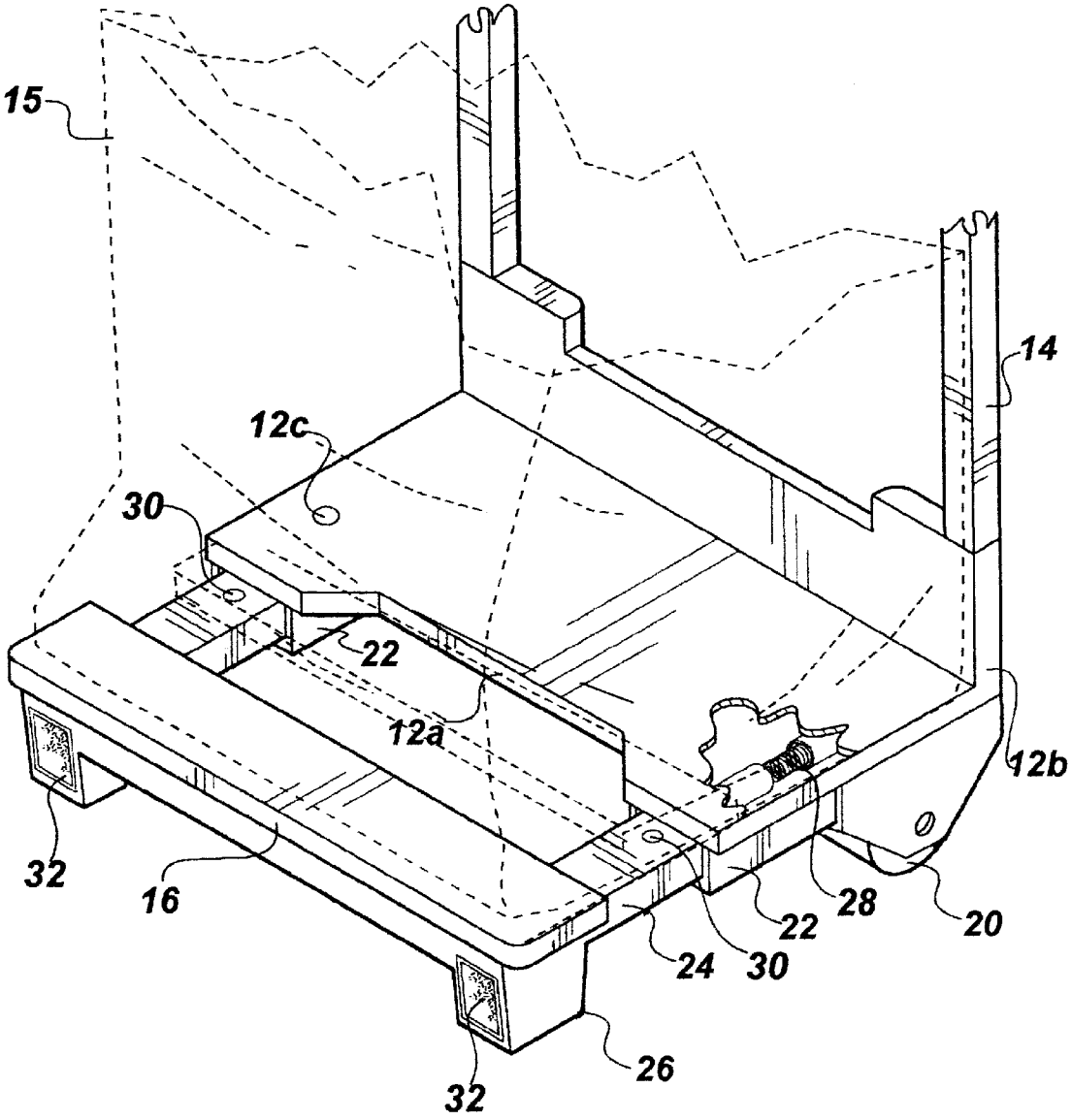
FIG. 2 is a partial, cut-away, perspective view of a backpack and support structure therefor according to the present invention.
Figure 3:
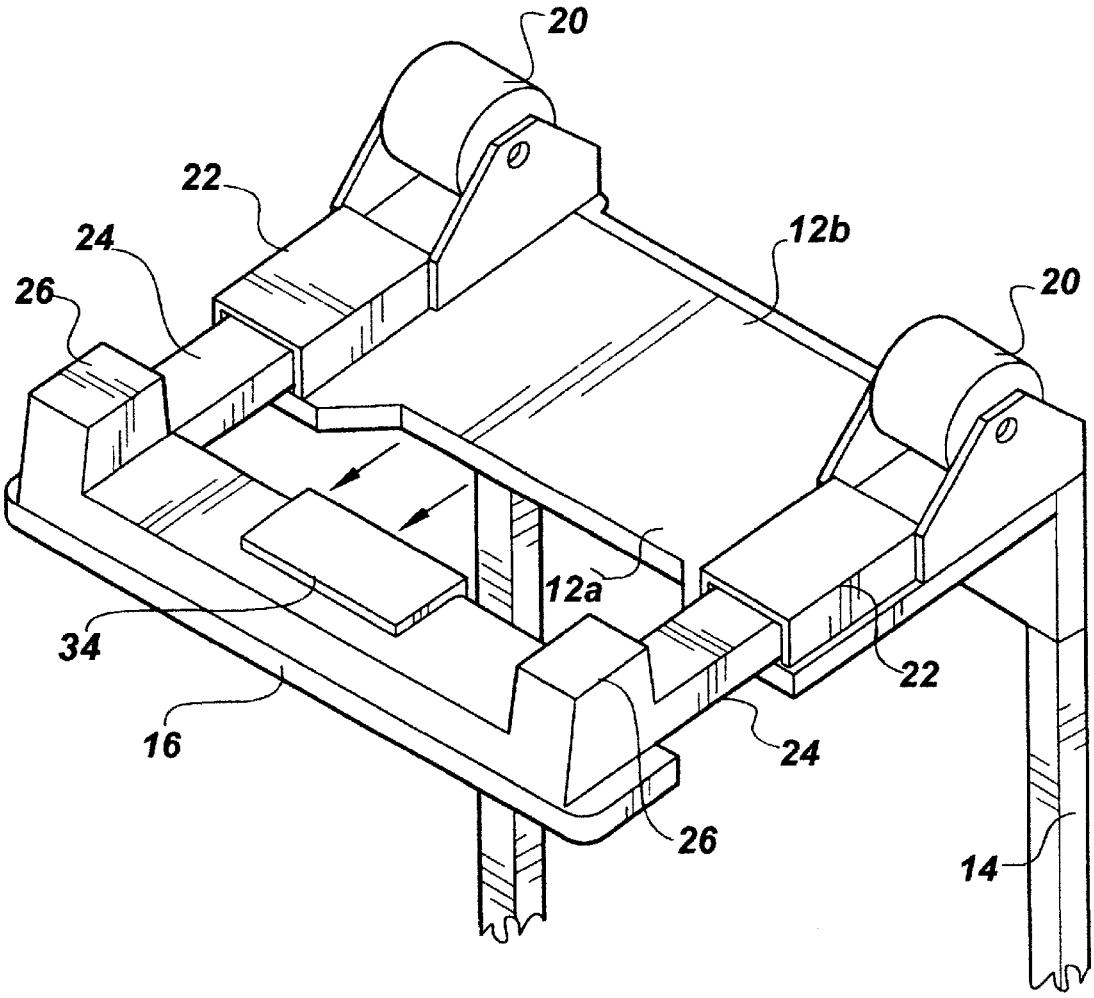
FIG. 3 is a partial, perspective view of a second embodiment of a backpack support structure according to the present invention.
Figure 4:
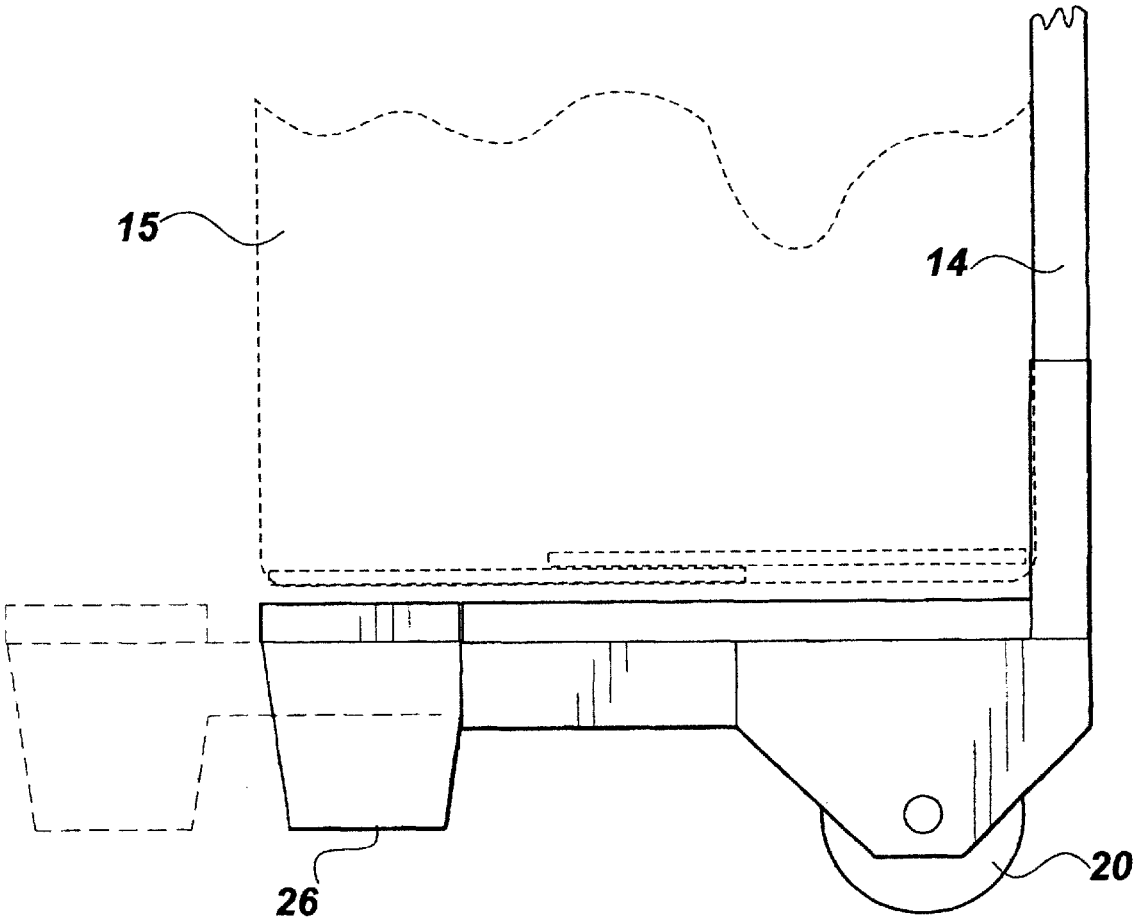
FIG. 4 is a partial, side view of a backpack and support structure therefor according to the present invention.

As best illustrated in FIGS. 2–4, a pair of wheels 20 are positioned on the underside of base member 12 at rear end 12*b*. As noted above, wheels 20 are of the skateboard type and are designed for rugged wear and tear. A channel member 22 is disposed adjacent each wheel 20 and extends in a forward direction to the front end 12*a* of base member 12. A channel insert 24 extends from each side of movable member 16. Each channel insert 24 has a first end inserted in a respective channel 22. Each insert 24 has a second end which terminates in a foot 26. Springs 28 (only one is shown) are disposed in each channel to bias inserts 24 and member 16 away from front end 12*a*. Forward or rearward movement of member 16 causes overlapping backpack walls 15*a* to move in the respective direction thereby allowing the backpack to expand or compress. Conventional, spring-biased, locking cylinders 30 function to engage openings 12*c* in base member 12 to lock member 16 in a retracted position. Dual actuator buttons 32 (FIG. 2) utilize conventional mechanisms (not shown) to release locking cylinders 30 and allow member 16 and backpack 15 to assume an expanded state. Alternatively, a single actuator 34 (FIG. 3) may be used to release cylinders 30.

As contemplated, the backpack 15 can be made from a soft, durable material (cloth, leather, etc.) and will be attached to base 12 and handle 14 in any suitable and convenient manner. Base 12 (and attendant parts) and handle 14 can be fabricated from any strong, rigid, durable, lightweight material (metal, plastic, etc.). The structure will have a width of approximately eight inches and a height of approximately seventeen inches. In its retracted state the structure will extend approximately five and one-half inches from front to rear. These dimensions will allow the backpack to fit into the majority of school lockers.

It is to be understood that the present invention is not limited to the embodiments described above, but encompasses any and all embodiments within the scope of the following claims.

We claim:

1. An expandable and compressible luggage apparatus comprising:

a base member, said base member having a front end, a rear end, an upper side defining a support area and an under side;

first means for expanding and compressing said support area, said first means including a pair of channel members positioned on the under side of said base member and a movable member mounted adjacent said front end of said base member and telescopically coupled to said pair of channel members;

a backpack, said backpack mounted on said upper side of said base member and having spaced walls defining a closed volume; and second means for expanding and compressing said closed volume of said backpack.

2. The expandable and compressible luggage apparatus as recited in claim 1 including:

a pair of channel insert members connected to and extending from said movable member, each member of said pair of channel insert members having a first end and a second end, each said first end disposed in a respective channel member.

3. The expandable and compressible luggage apparatus as recited in claim 2 including:

a spring disposed in each of said pair of channel members and abutting said first end of each said pair of channel insert members, each said spring adapted to bias said movable member away from said front end of said base member.

4. The expandable and compressible luggage apparatus as recited in claim 3 including:

a locking cylinder disposed in each of said pair of channel insert members, each said locking cylinder adapted to engage said base member and prevent each said spring from biasing said movable member away from said front end of said base member.

5. The expandable and compressible luggage apparatus as recited in claim 4 including:

a pair of wheels disposed on said underside of said base member adjacent said rear end.

6. The expandable and compressible luggage apparatus as recited in claim 5 including:

a handle disposed on said upper side of said base member adjacent said rear end, said handle extending vertically upward from said base member.

7. The expandable and compressible luggage apparatus as recited in claim 6 including:

a set of shoulder straps affixed to said handle.

8. The expandable and compressible luggage apparatus as recited in claim 7 including:

a foot portion disposed on each said second end of each said pair of channel insert members.

9. The expandable and compressible luggage apparatus as recited in claim 8 including:

an actuator disposed on said movable member, said actuator adapted to move said locking cylinder and release said movable member.

10. The expandable and compressible luggage apparatus as recited in claim 9 wherein said second means includes overlapping walls.

11. An expandable and compressible luggage apparatus comprising:

a base member, said base member having a front end, a rear end, an upper side defining a support area and an under side;

means for expanding and compressing said support area, said expanding and compressing means includes:

a pair of channel members positioned on the under side of said base member; and a movable member mounted adjacent said front end of said base member and telescopically coupled to said pair of channel members;

a backpack, said backpack mounted on said upper side of said base member, said backpack having spaced, overlapping walls defining a closed volume, whereby said closed volume can be expanded and compressed.

12. The expandable and compressible luggage apparatus as recited in claim 11 including:

a pair of channel insert members connected to and extending from said movable member, each member of said pair of channel insert members having a first end and a second end, each said first end disposed in a respective channel member.

13. The expandable and compressible luggage apparatus as recited in claim 12 including:

a spring disposed in each of said pair of channel members and abutting said first end of each said pair of channel insert members, each said spring adapted to bias said movable member away from said front end of said base member.

14. The expandable and compressible luggage apparatus as recited in claim 13 including:

a locking cylinder disposed in each of said pair of channel insert members, each said locking cylinder adapted to engage said base member and prevent each said spring from biasing said movable member away from said front end of said base member.

15. The expandable and compressible luggage apparatus as recited in claim 14 including:

a pair of wheels disposed on said underside of said base member adjacent said rear end.

16. The expandable and compressible luggage apparatus as recited in claim 15 including:

a handle disposed on said upper side of said base member adjacent said rear end, said handle extending vertically upward from said base member.

17. The expandable and compressible luggage apparatus as recited in claim 16 including:

a set of shoulder straps affixed to said handle.

18. The expandable and compressible luggage apparatus as recited in claim 17 including:

an actuator disposed on said movable member, said actuator adapted to move said locking cylinder and release said movable member.

* * * * *